US006834725B2

(12) United States Patent
Whanger et al.

(10) Patent No.: US 6,834,725 B2
(45) Date of Patent: Dec. 28, 2004

(54) REINFORCED SWELLING ELASTOMER SEAL ELEMENT ON EXPANDABLE TUBULAR

(75) Inventors: James K. Whanger, Houston, TX (US); Simon J. Harrall, Inverurie (GB)

(73) Assignee: Weatherford/Lamb, Inc., Houston, TX (US)

( * ) Notice: Subject to any disclaimer, the term of this patent is extended or adjusted under 35 U.S.C. 154(b) by 35 days.

(21) Appl. No.: 10/317,843

(22) Filed: Dec. 12, 2002

(65) Prior Publication Data

US 2004/0112609 A1 Jun. 17, 2004

(51) Int. Cl.[7] ..... E21B 33/128; E21B 23/06; E21B 29/00

(52) U.S. Cl. ..... 166/384; 166/55.7; 166/123; 166/279; 277/340; 277/933; 277/944

(58) Field of Search ..... 166/297, 277, 166/381, 384, 387, 55, 55.1, 55.6, 55.7, 179, 118, 123, 140, 195, 196, 203, 206, 207, 208, 212, 217, 242.1, 242.2; 277/336, 334, 934, 931, 933, 944, 340

(56) References Cited

U.S. PATENT DOCUMENTS

| | | | | |
|---|---|---|---|---|
| 2,306,160 A | | 12/1942 | Freyssinet | 288/6 |
| 2,519,116 A | | 8/1950 | Crake | 166/10 |
| 2,656,891 A | | 11/1953 | Toelke | 166/13 |
| 2,814,517 A | | 11/1957 | Razdow | 288/20 |
| 2,945,541 A | | 7/1960 | Maly et al. | 166/187 |
| 3,147,016 A | | 9/1964 | Traufler | 277/226 |
| 3,385,367 A | | 5/1968 | Kollsman | 166/191 |
| 3,593,799 A | | 7/1971 | Boughton et al. | 166/295 |
| 3,677,987 A | | 7/1972 | Pence, Jr. | 260/29.6 |
| 3,690,375 A | | 9/1972 | Shillander | 166/187 |
| 3,740,360 A | | 6/1973 | Nimerick | 260/17.4 |
| 3,918,523 A | | 11/1975 | Stuber | 166/285 |
| 4,078,606 A | | 3/1978 | Montgomery | 166/120 |
| 4,137,970 A | | 2/1979 | Laflin et al. | 166/292 |
| 4,253,676 A | | 3/1981 | Baker et al. | 277/34.6 |
| 4,300,775 A | | 11/1981 | Ringel | 277/34.3 |
| 4,403,660 A | | 9/1983 | Coone | 166/287 |
| 4,406,469 A | | 9/1983 | Allison | 277/123 |
| 4,424,861 A | * | 1/1984 | Carter, Jr. et al. | 277/334 |
| 4,452,463 A | | 6/1984 | Buckner | 277/120 |
| 4,457,369 A | | 7/1984 | Henderson | 166/125 |
| 4,601,498 A | | 7/1986 | Haugen | 285/332.3 |

(List continued on next page.)

FOREIGN PATENT DOCUMENTS

| | | | | |
|---|---|---|---|---|
| EP | 0 237 662 | | 9/1987 | E21B/34/10 |
| JP | 409151686 A | * | 6/1997 | E21B/33/127 |
| WO | WO 02/20941 | | 3/2002 | E21B/33/128 |
| WO | WO 02/038343 | | 5/2002 | |
| WO | WO 02/059452 A1 | | 8/2002 | E21B/33/00 |
| WO | WO 03/023186 | | 3/2003 | |

OTHER PUBLICATIONS

U.K. Search Report, Application No. GB 0328867.7, dated Apr. 28, 2004.

(List continued on next page.)

*Primary Examiner*—David Bagnell
*Assistant Examiner*—Jennifer Gay
(74) *Attorney, Agent, or Firm*—Moser, Patterson & Sheridan, L.L.P.

(57) ABSTRACT

An apparatus and method used for sealing a wellbore. The apparatus includes a swelling elastomer disposed around an outer surface of the tubular body. The swelling elastomer is isolated from wellbore fluid in an annulus. However, upon the application of an outwardly directed force to an inner surface of the tubular body, the tubular body expands radially outward causing the swelling elastomer to contact the wellbore while exposing the swelling elastomer to an activating agent via the one or more apertures, thereby causing the swelling elastomer to create a pressure energized seal with one or more adjacent surfaces in the wellbore.

31 Claims, 6 Drawing Sheets

U.S. PATENT DOCUMENTS

| | | | | | |
|---|---|---|---|---|---|
| 4,633,950 | A | | 1/1987 | Delhommer et al. | 166/295 |
| 4,662,450 | A | | 5/1987 | Haugen | 166/299 |
| 4,674,570 | A | | 6/1987 | Jackson | 166/187 |
| 4,730,670 | A | | 3/1988 | Kim | 166/134 |
| 4,762,179 | A | | 8/1988 | Wesson et al. | 166/297 |
| 4,836,940 | A | | 6/1989 | Alexander | 252/8.512 |
| 4,862,967 | A | | 9/1989 | Harris | 166/387 |
| 4,886,117 | A | | 12/1989 | Patel | 166/187 |
| 4,907,651 | A | | 3/1990 | Bou-Mikael | 166/114 |
| 4,913,232 | A | | 4/1990 | Cheymol et al. | 166/285 |
| 4,919,989 | A | | 4/1990 | Colangelo | |
| 4,936,386 | A | | 6/1990 | Colangelo | |
| 4,979,570 | A | * | 12/1990 | Mody | 166/387 |
| 5,086,841 | A | | 2/1992 | Reid et al. | 166/295 |
| 5,101,908 | A | * | 4/1992 | Mody | 166/387 |
| 5,165,703 | A | | 11/1992 | Morvant | 277/188 |
| 5,186,258 | A | * | 2/1993 | Wood et al. | 166/387 |
| 5,226,492 | A | | 7/1993 | Solaeche P. et al. | 166/196 |
| 5,271,469 | A | | 12/1993 | Brooks et al. | 166/387 |
| 5,309,993 | A | | 5/1994 | Coon et al. | 166/115 |
| 5,311,938 | A | | 5/1994 | Hendrickson et al. | 166/134 |
| 5,469,919 | A | * | 11/1995 | Carisella | 166/387 |
| 5,511,620 | A | | 4/1996 | Baugh et al. | 166/387 |
| 5,564,504 | A | * | 10/1996 | Carisella | 166/387 |
| 5,605,195 | A | | 2/1997 | Eslinger et al. | 166/387 |
| 5,623,993 | A | | 4/1997 | Van Buskirk et al. | 166/292 |
| 5,676,384 | A | | 10/1997 | Culpepper | 277/188 |
| 5,749,585 | A | | 5/1998 | Lembcke | 277/116.2 |
| 5,787,987 | A | | 8/1998 | Forsyth et al. | 166/313 |
| 5,803,178 | A | | 9/1998 | Cain | 166/306 |
| 5,833,001 | A | | 11/1998 | Song et al. | 166/287 |
| 5,875,847 | A | | 3/1999 | Forsyth | 166/313 |
| 5,941,313 | A | | 8/1999 | Arizmendi | 166/387 |
| 6,009,951 | A | | 1/2000 | Coronado et al. | 166/387 |
| 6,041,858 | A | | 3/2000 | Arizmendi | 166/187 |
| 6,073,692 | A | | 6/2000 | Wood et al. | 166/187 |
| 6,286,603 | B1 | * | 9/2001 | Parent | 166/387 |
| 6,446,717 | B1 | | 9/2002 | White et al. | 166/187 |
| 6,581,682 | B1 | * | 6/2003 | Parent et al. | 166/180 |
| 6,662,876 | B2 | * | 12/2003 | Lauritzen | 166/380 |
| 2002/0066576 | A1 | | 6/2002 | Cook et al. | |
| 2002/0195256 | A1 | * | 12/2002 | Metcalfe et al. | 166/387 |
| 2003/0042028 | A1 | * | 3/2003 | Lauritzen et al. | 166/384 |
| 2003/0127225 | A1 | * | 7/2003 | Harrall et al. | 166/285 |
| 2003/0146003 | A1 | * | 8/2003 | Duggan et al. | 166/384 |
| 2004/0020662 | A1 | * | 2/2004 | Freyer | 166/387 |
| 2004/0055758 | A1 | * | 3/2004 | Brezinski et al. | 166/384 |
| 2004/0112609 | A1 | * | 6/2004 | Whanger et al. | 166/380 |
| 2004/0118572 | A1 | * | 6/2004 | Whanger et al. | 166/384 |

OTHER PUBLICATIONS

U.S. patent application Ser. No. 10/443,442, Whanger et al., filed May 22, 2003.

U.S. patent application Ser. No. 10/328,708, Whanger et al., filed Dec. 23, 2002.

U.S. patent application Ser. No. 10/255,571, Stephenson, filed Sep. 26, 2002.

U.S. patent application Ser. No. 10/034,592, Lauritzen et al., filed Dec. 28, 2001.

* cited by examiner

REINFORCED SWELLING ELASTOMER SEAL ELEMENT ON EXPANDABLE TUBULAR

BACKGROUND OF THE INVENTION

1. Field of the Invention

The present invention generally relates to downhole tools for use in a wellbore. More particularly, the invention relates to a downhole tool for sealing a wellbore, such as a hydrocarbon wellbore. More particularly still, the invention relates to an expandable tubular for sealing a hydrocarbon wellbore.

2. Description of the Related Art

Typically, a wellbore is formed using a drill bit that is urged downwardly at a lower end of a drill string. After drilling to a predetermined depth, the drill string and bit are removed, and the wellbore is lined with a string of casing. Generally, it is desirable to provide a flow path for hydrocarbons from the surrounding formation into the newly formed wellbore. Therefore, after all casing has been set and cemented, perforations are formed in a wall of the liner string at a depth that equates to the anticipated depth of hydrocarbons. Alternatively, a lower portion of the wellbore may remain uncased, which is commonly referred to as an open-hole completion, so that the formation and fluids residing therein remain exposed to the wellbore.

A downhole packer is generally used to isolate a specific portion of a wellbore whether it is employed in a cased or uncased wellbore. There are many different types of packers; however, a recent trend in cased wellbore completion has been the advent of expandable tubular technology. It has been discovered that expandable packers can be expanded in situ so as to enlarge the inner diameter. This, in turn, enlarges the path through which both fluid and downhole tools may travel. Also, expansion technology enables a smaller tubular such as the expandable packer to be run into a larger tubular, and then expanded so that a portion of the smaller tubular is in contact with the larger tubular therearound. Expandable packers are expanded through the use of a cone-shaped mandrel or by an expansion tool with expandable, fluid actuated members disposed on a body and run into the wellbore on a tubular string. During the expansion operation, the walls of the expandable packer are expanded past their elastic limit. The use of expandable packers allows for the use of larger diameter production tubing, because the conventional slip mechanism and sealing mechanism are eliminated.

An expandable packer is typically run into the wellbore with a running assembly disposed at an end of a drill string. The running assembly includes an expansion tool, a swivel, and a running tool. Generally, the expansion tool is disposed at the bottom end of the drill string. Next, the swivel is disposed between the expansion tool and the running tool to allow the expansion tool to rotate while the running tool remains stationary. Finally, the running tool is located below the swivel, at the bottom end of the running assembly. The running tool is mechanically attached to the expandable packer through a mechanical holding device.

After the expandable packer is lowered to a predetermined point in the well, the expandable packer is ready to be expanded into contact with the wellbore or casing. Subsequently, the expansion tool is activated when a hydraulic isolation device, like a ball, is circulated down into a seat in the expansion tool. Thereafter, fluid is pumped from the surface of the wellbore down the drill string into the expansion tool. When the fluid pressure builds up to a predetermined level, the expansion tool is activated, thereby starting the expansion operation. During the expansion operation, the swivel allows the expansion tool to rotate while the packer and the running tool remain stationary. After the expandable packer has been expanded against the wellbore or casing, the running assembly is deactivated and removed from the well.

While expanding tubulars in a wellbore offer obvious advantages, there are problems associated with using the technology to create a packer through the expansion of one tubular into a wellbore or another tubular. For example, an expanded packer with no gripping structure on the outer surface has a reduced capacity to support the weight of the entire packer. This is due to a reduced coefficient of friction on the outer surface of the expandable packer. More importantly, the expansion of the expandable packer in an open-hole wellbore may result in an ineffective seal between the expanded packer and the surrounding wellbore.

An alternative to the expandable packer is an inflatable packer. Typically, the inflatable packer utilizes an expandable bladder to create a fluid seal within the surrounding wellbore or casing. In some instances, the bladder is expanded through actuation of a downhole pump. In other instances, the bladder is expanded through injection of hydraulic pressure into the tool. Inflation of the bladder forces a surrounding packing element to be inflated into a sealed engagement with the surrounding wellbore or string of casing.

The packer element in a typical inflatable packer is comprised of two separate portions. The first portion is an expandable rib assembly. Typically, the rib assembly defines a series of vertically overlaid reinforcing straps that are exposed to the surrounding casing. The straps are placed radially around the bladder in a tightly overlapping fashion. The second portion of the inflatable packer is an expandable sealing cover with a valve system. The sealing cover is a pliable material that surrounds a portion of the reinforcing straps. As the bladder and straps are expanded, the sealing cover expands and engages the surrounding pipe in order to effectuate a fluid seal. Thus, the rib assembly and the sealing cover portion of the packing element combine to effectuate a setting and sealing function.

While an inflatable packer offers an increased sealing capability over the expandable packer, there are potential problems associated with the inflatable packer. In one example, the inflatable packer rib assembly may be complex and costly to manufacture. In another example, the valve system is complex and may not function properly. More importantly, the inflatable packer reduces the hole size of the wellbore, thereby limiting the further drilling or exploration of the wellbore.

There is a need, therefore, for a packer that will create an effective seal by exerting pressure against a cased wellbore or an open-hole wellbore. There is a further need for a packer that will not reduce the diameter of the wellbore. There is yet a further need for a cost effective packer. Finally, there is a need for a liner assembly that will effectively isolate a zone within an open-hole or a cased wellbore.

SUMMARY OF THE INVENTION

The present invention generally relates to an apparatus and method for sealing a wellbore. In one aspect an apparatus for sealing a wellbore is provided. The apparatus includes a tubular body having an inner surface and an outer surface. The tubular body contains one or more apertures in a wall thereof to allow selective fluid communication between the inner surface and the outer surface. The apparatus further includes a swelling elastomer disposed around the outer surface of the tubular body. The swelling elastomer is isolated from wellbore fluid in an annulus. However, upon the application of an outwardly directed force to the inner surface of the tubular body, the tubular body expands radially outward causing the swelling elastomer to contact the wellbore while exposing the swelling elastomer to an activating agent via the one or more apertures, thereby causing the swelling elastomer to create a pressure energized seal with one or more adjacent surfaces in the wellbore.

In another aspect, a liner assembly for isolating a zone in a wellbore is provided. The liner assembly includes a deformable tubular and an upper and lower sealing apparatus disposed at either end of the deformable tubular. The upper and lower sealing apparatus comprises a tubular body, a swelling elastomer, and a deformable portion.

In yet another aspect, a method for sealing a wellbore is provided. The method includes running an expandable liner assembly on a drill string into the wellbore. The expandable liner assembly includes a deformable tubular and a sealing apparatus disposed at either end of the deformable tubular. The method further includes applying an outwardly directed force to the inner surface of a tubular body and causing the tubular body to expand radially outward. The method also includes exposing the swelling elastomer to an activating agent, thereby causing the swelling elastomer to expand outward deforming the deformable portion to create a pressure energized seal with one or more adjacent surfaces in the wellbore. The method includes expanding the deformable tubular.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
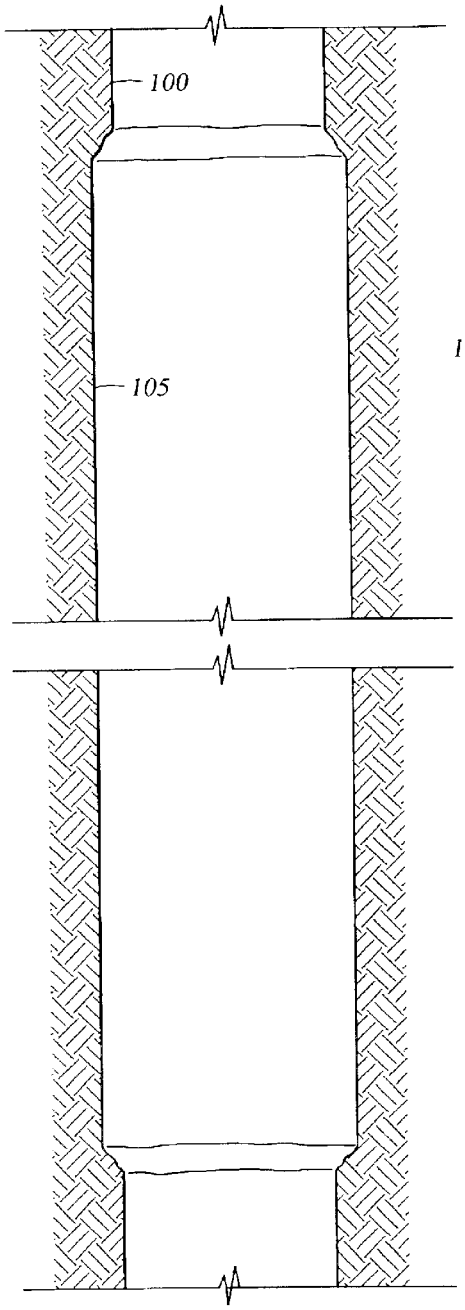
FIG. 1 is a cross-sectional view of a wellbore prepared to accept an expandable sealing assembly that includes an upper and lower sealing apparatus of the present invention.

FIG. 1 is a cross-sectional view of a wellbore 100 prepared to accept an expandable liner assembly (not shown) that includes an upper and lower sealing apparatus (not shown) of the present invention. As depicted, wellbore 100 does not contain casing. An uncased wellbore is known in the industry as an open-hole wellbore. It should be noted that this invention is not limited for use with uncased wellbore, but rather can be also be used with a cased wellbore. In a cased wellbore, the casing is typically perforated at a predetermined location near a formation to provide a flow path for hydrocarbons from the surrounding formation. Thereafter, the perforations may be closed by employing the present invention in a similar manner as described below for an open-hole wellbore.

As shown in FIG. 1, the wellbore 100 is a vertical well. However, it should be noted that the present invention may also be employed in horizontal or deviated wellbores. As illustrated in FIG. 1, a prepared section 105 has an enlarged diameter relative to the wellbore 100. Typically, the prepared section 105 is enlarged through the use of an under-reamer (not shown). However, other methods of enlarging the wellbore 100 may be employed, such as a bi-center bit, so long as the method is capable of enlarging the diameter of the wellbore 100 for a predetermined length.

In a typical under-reaming operation, the wellbore 100 is enlarged past its original drilled diameter. The under-reamer generally includes blades that are biased closed during run-in for ease of insertion into the wellbore 100. The blades may subsequently be activated by fluid pressure to extend outward and into contact with the wellbore walls. Prior to the under-reaming operation, the under-reamer is located at a predetermined point in the wellbore 100. Thereafter, the under-reamer is activated, thereby extending the blades radially outward. A rotational force supplied by a motor causes the under-reamer to rotate. During rotation, the under-reamer is urged away from the entrance of the wellbore 100 toward a downhole position for a predetermined length. As the under-reamer travels down the wellbore, the blades on the front portion of the under-reamer contact the diameter of the wellbore 100, thereby enlarging the diameter of the wellbore 100 to form the prepared section 105.

Figure 2A:
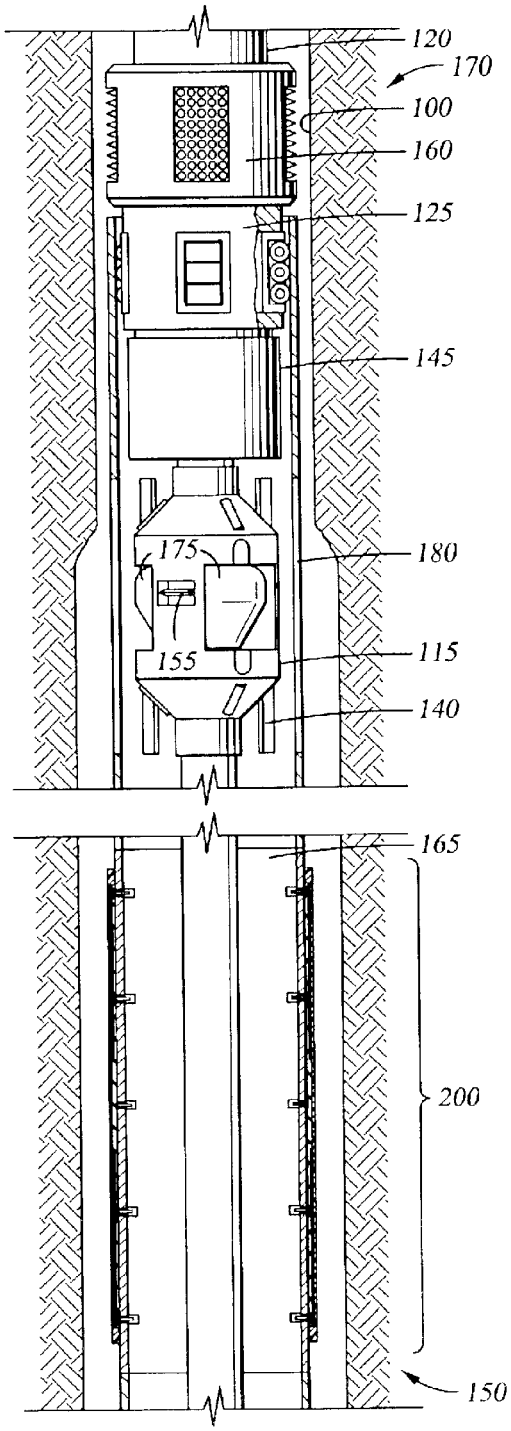
FIGS. 2A and 2B are cross-sectional views illustrating the expandable liner assembly and a running assembly being lowered into the wellbore on a work string.
Figure 2B:
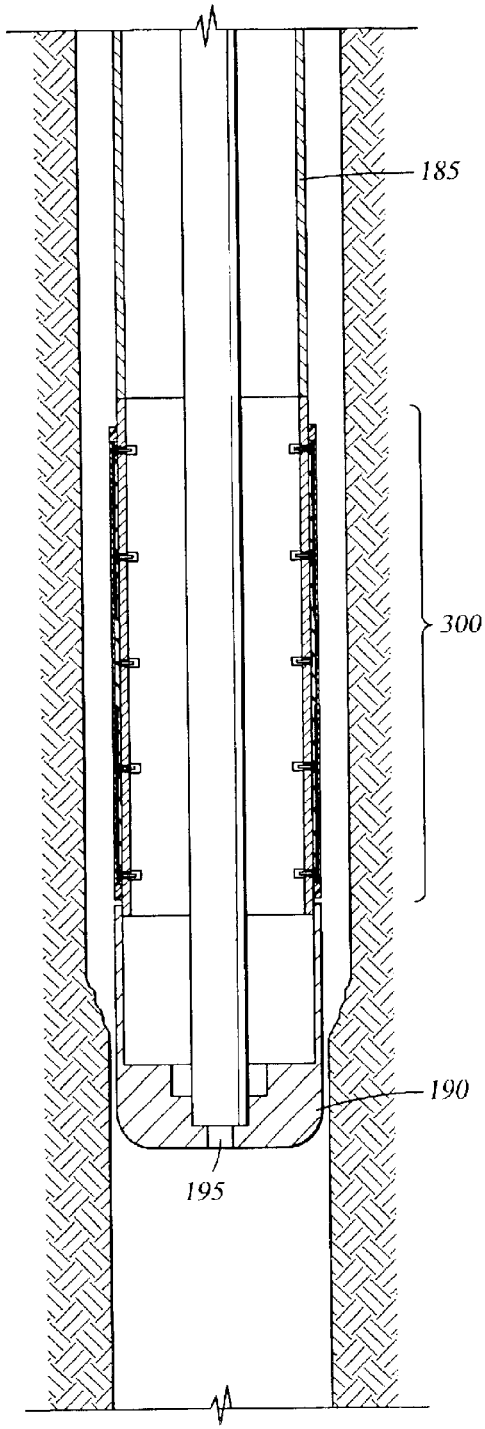

FIGS. 2A and 2B are cross-sectional views illustrating the expandable liner assembly 150 and a running assembly 170 being lowered into the wellbore 100 on a work string 120. Additionally, the work string 120 acts as a conduit for hydraulic fluid that is pumped from the surface of the wellbore 100 to the various components on the running assembly 170. As shown, the work string 120 extends through the entire length of the running assembly 170 and connects to a drillable plug 190 at the lower end of the running assembly 170. During the run-in operation, the drillable plug 190 prevents wellbore fluid from entering an annulus 165 created between the expandable liner assembly 150 and the running assembly 170. As depicted, the plug 190 includes an aperture 195 to allow hydraulic fluid to exit the work string 120 during the expansion operation.

The running assembly 170 further includes an upper torque anchor 160 to provide a means to secure the running assembly 170 and expandable liner assembly 150 in the wellbore 100. As shown on FIG. 2A, the upper torque anchor 160 is in a retracted position to allow the running assembly 170 to place the expandable liner assembly 150 in the desired location for expansion of the liner assembly 150 in the prepared section 105. The upper torque anchor 160 illustrates one possible means of securing the running assembly 170 and expandable liner assembly 150 in the wellbore 100. It should be noted, however, that other securing means well known in the art may be employed so long as they are capable of securing the running assembly 170 and expandable liner assembly 150 in the wellbore 100. Additionally, a lower torque anchor 125, which is disposed below the upper torque anchor 160, is used to attach the expandable liner assembly 150 to the running assembly 170. At the lower end of the torque anchor 125, a motor 145 is disposed to provide the rotational force to turn the expansion tool 115.

FIG. 2A depicts the expansion tool 115 with rollers 175 retracted, so that the expansion tool 115 may be easily moved within the expandable liner assembly 150 and placed in the desired location for expansion of the liner assembly 150. When the expansion tool 115 has been located at the desired depth, hydraulic pressure is used to actuate the pistons (not shown) and to extend the rollers 175 so that they may contact the inner surface of the liner assembly 150, thereby expanding the liner assembly 150. Generally, hydraulic fluid (not shown) is pumped from the surface to the expansion tool 115 through the work string 120. Additionally, the expansion tool includes blades 155 to cut the liner assembly at a predetermined location.

As illustrated in FIG. 2A, the expandable liner assembly 150 includes an upper tubular 180. The upper tubular 180 includes a plurality of slots 140 formed on the surface of the upper tubular 180. Generally, the slots 140 are a plurality of longitudinal slots in the upper tubular 180 to provide a point where an upper and lower portion of the liner assembly 150 may separate after the expansion process is complete. The expandable liner assembly 150 further includes the upper sealing apparatus 200 and the lower sealing apparatus 300. Generally, the upper and lower sealing apparatus 200, 300 are used in conjunction with a lower tubular 185 to seal off a portion of the prepared section 105 in order to isolate a zone of the wellbore 100. As shown in FIGS. 2A and 2B, the components for the sealing apparatus 200, 300 are identical. Therefore, the following paragraphs describing the components in the upper sealing apparatus 200 will also be applicable to the lower sealing apparatus 300.

As depicted on FIG. 2A, the expandable liner assembly 150 also includes the lower tubular 185 disposed between the upper and lower sealing apparatus 200, 300. Generally, the lower tubular 185 is expanded into the prepared section 105 by the expansion tool 115. In the embodiment shown, the lower tubular 185 is an expandable liner that works in conjunction with the upper and lower sealing apparatus 200, 300 to isolate a portion of the prepared section 105 from other portions of the wellbore 100. However, other forms of expandable tubulars may be employed, such as expandable screens or metal skin, so long as they are capable of isolating a zone of the wellbore 100.

Figure 3A:
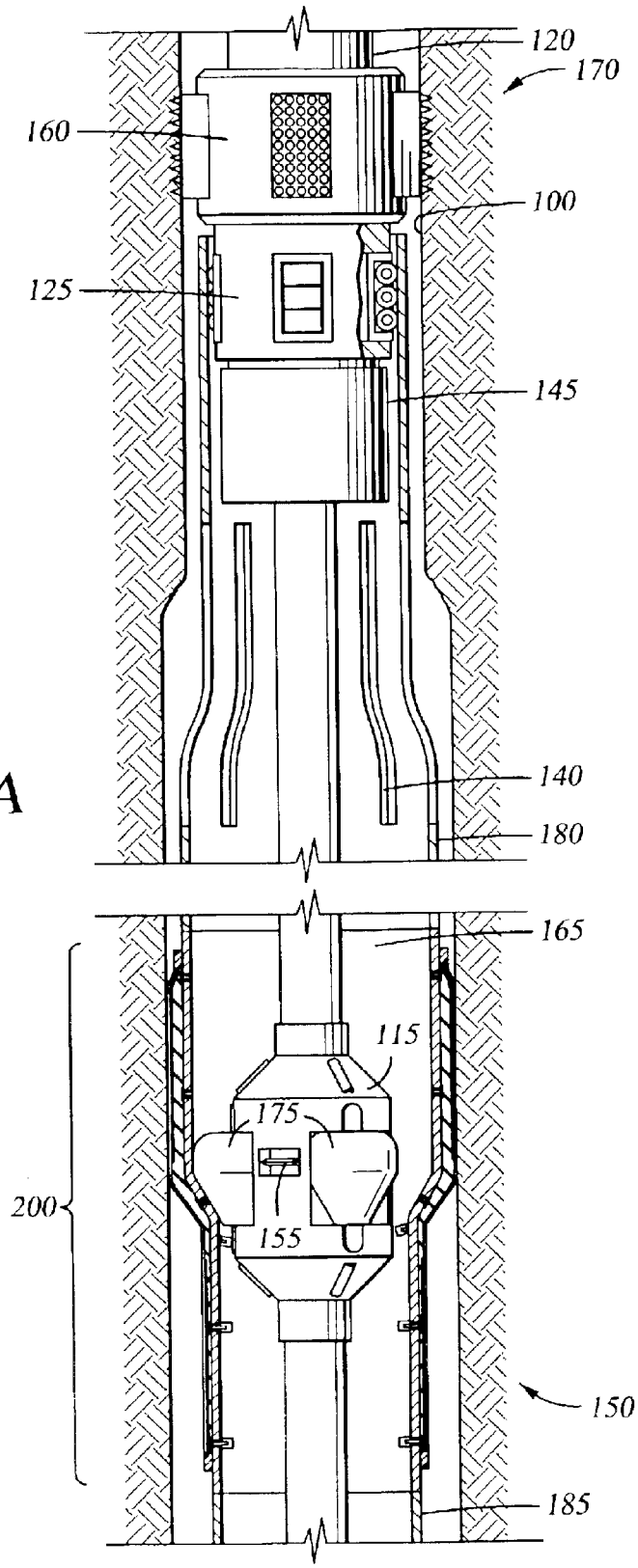
FIG. 3A is a cross-sectional view illustrating the upper sealing apparatus partially expanded into contact with the wellbore by an expansion tool.
Figure 3B:
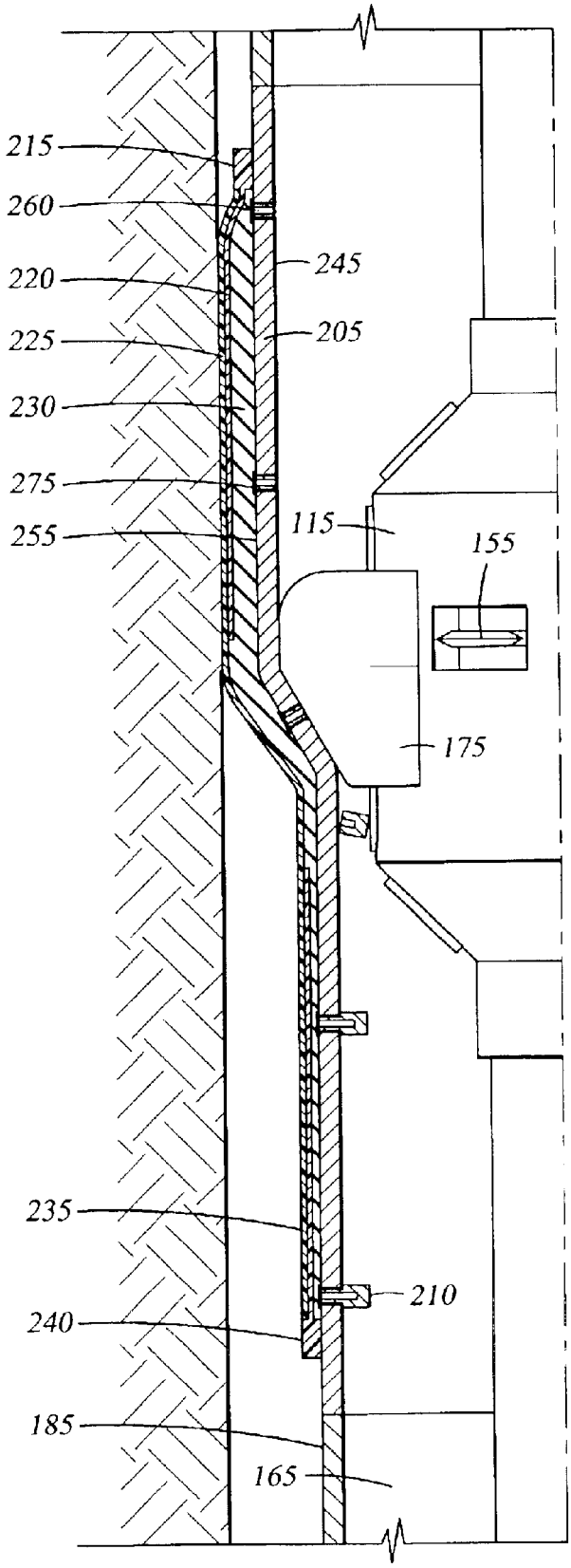
FIG. 3B is an enlarged cross-sectional view illustrating the expansion of the swelling elastomer in the upper sealing apparatus.

FIGS. 3A and 3B are cross-sectional views illustrating the upper sealing apparatus 200 partially expanded into contact with the wellbore 100 by the expansion tool 115. As shown on FIG. 3B, the upper sealing apparatus 200 includes an expandable tubular 205. The expandable tubular 205 has an inner surface 245 and an outer surface 255. The expandable tubular 205 further includes a plurality of apertures 260 that are equally spaced around the circumference of the expandable tubular 205 and act as passageways between the inner surface 245 and the outer surface 255. In the embodiment shown, the apertures 260 are tapped and plugged by a plurality of plug members 210 to initially prevent communication between the inner surface 245 and the outer surface 255. Additionally, a plurality of fine mesh screens 275 are disposed on outer surface 255 around the plurality of apertures 260. In another embodiment, the apertures 260 remain unplugged, thereby allowing communication between the inner surface 245 and the outer surface 255.

The upper sealing apparatus 200 further includes an upper end member 215 and a lower end member 240 disposed around the outer surface 255 of the expandable tubular 205. The upper and lower end members 215, 240 are machined out of a composite material which allows the end members 215, 240 to expand radially outward while maintaining a clamping force and structural integrity. However, other types of material may be used to machine the end members 215, 240, so long as they are capable of expanding radially outward while maintaining a clamping force and structural integrity.

The upper end member 215 is disposed at the upper end of the sealing apparatus 200. The primary function of the upper end member 215 is to secure one end of a plurality of upper ribs 220 and an upper end of a sealing element 225 to the expandable tubular 205. Preferably, the upper ribs 220 are equally spaced around the outer surface 255 of the expandable tubular 205. The upper ribs 220 are embedded in the sealing element 225 to provide support during the expansion of the upper sealing apparatus 200. The upper ribs 220 are fabricated out of deformable material such as aluminum. However, other types of deformable material may be employed, so long as the material is capable of providing support while deforming due to pressure. Additionally, the lower end member 240 secures one end of a plurality of lower ribs 235 and the lower end of sealing element 225 to the tubular 205 in the same manner as the upper end member 215.

The upper sealing apparatus 200 further includes the sealing element 225. The sealing element 225 is disposed around the tubular 205 to increase the ability of the sealing apparatus 200 to seal against an inner surface of the wellbore 100 upon expansion. In the preferred embodiment, the sealing element 225 is fabricated from an elastomeric material. However, other materials may be used, so long as they are suitable for enhancing the fluid seal between the expanded portion of the sealing apparatus 200 and the wellbore 100. The sealing element 225 is secured at the upper end of the sealing apparatus 200 by the upper end member 215 and the lower end by the lower end member 240. Another function of the sealing element 225 is to contain a swelling elastomer 230 that is disposed between the outer surface 255 of the expandable tubular 205 and the sealing element 225.

The swelling elastomer 230 is a cross-linked polymer that will swell multiple times its initial size upon activation by an activating agent. Generally, the activating agent stimulates the polymer chains to expand the swelling elastomer 230 both radial and axially. In the preferred embodiment, an activating agent such as a proprietary fluid or some form of water-based liquid activates the swelling elastomer 230. However, other embodiments may employ different types of swelling elastomers that are activated by other forms of activating agents. In the preferred embodiment, the swelling elastomer 230 is wrapped around the outer surface 255 of the expandable tubular 205 in an inactivated state. The plug members 210 disposed in the apertures 260 act as a fluid barrier to prevent any fluid or activating agent from contacting the swelling elastomer 230 during the run-in procedure. Further, the swelling elastomer 230 is contained laterally by the upper and lower end members 215, 240 and contained radially by the deformable sealing element 225 and the deformable upper and lower ribs 220, 235. In this manner, the swelling elastomer 230 is substantially enclosed and maintained within a predefined location in an inactivated state and thereafter, within a controlled location in an activated state.

As depicted on FIG. 3A, the upper torque anchor 160 is energized to ensure the running assembly 170 and the expandable liner assembly 150 will not rotate during the expansion operation. Thereafter, at a predetermined pressure, the pistons (not shown) in the expansion tool 115 are actuated and the rollers 175 are extended until they contact the inner surface 245 of the expandable tubular 205. The rollers 175 of the expansion tool 115 are further extended until the rollers 175 plastically deform the expandable tubular 205 into a state of permanent expansion. The motor 145 rotates the expansion tool 115 during the expansion process, and the tubular 205 is expanded until the outer surface of the sealing element 225 contacts the inner surface of the wellbore 100. As the expansion tool 115 translates axially downward during the expansion operation, the rollers 175 knock off an upper portion of the plug members 210, thereby removing the fluid barrier to allow fluid in the annulus 165 to travel through the apertures 260 and the fine mesh screen 275 into contact with the swelling elastomer 230. As the fluid or activating agent contacts the swelling elastomer 230, the polymer chains change positions, thereby expanding the swelling elastomer 230 laterally and radially to create a pressure energized seal with one or more adjacent surfaces in the wellbore 100 as shown in FIG. 3B.

FIG. 3B is an enlarged cross-sectional view illustrating the expansion of the swelling elastomer 230 in the upper sealing apparatus 200. As shown in the upper portion of the sealing apparatus 200, the tubular 205 has been plastically deformed and the plug members 210 removed by the expansion tool 115. Additionally, fluid in the annulus 165 has entered the apertures 260 and activated an upper portion of the swelling elastomer 230. As the swelling elastomer 230 continues to expand, the upper and lower end members 215, 240 limit any lateral expansion while the fine mesh screen 275 limits any expansion through the apertures 260, thereby causing the majority of the expansion forces to act radially outward to deform the upper and lower ribs 220, 235 and the sealing element 225. As both the tubular 205 and the swelling elastomer 230 are expanded, the sealing element 225 engages the surrounding wellbore 100 and creates a pressure energized seal. After the entire upper sealing apparatus 200 is expanded radially outward, the expansion tool 115 continues laterally downward expanding the lower tubular 185.

Figure 4:
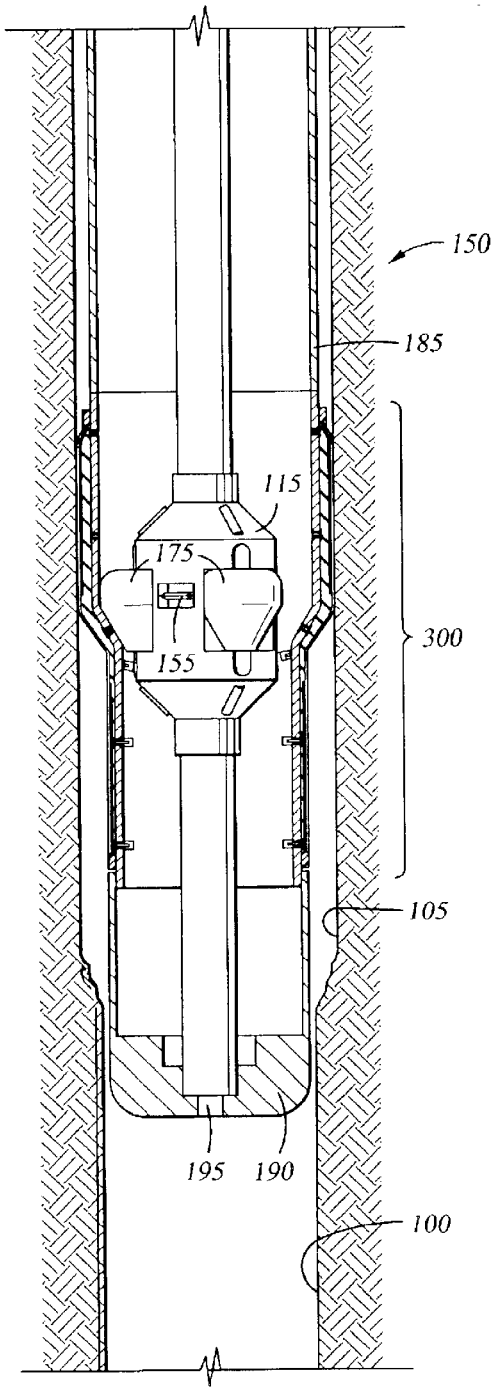
FIG. 4 is a cross-sectional view illustrating the lower sealing apparatus expanded into contact with the wellbore by the expansion tool.

FIG. 4 is a cross-sectional view illustrating the lower sealing apparatus 300 expanded into contact with the wellbore 100 by the expansion tool 115. As shown, the expansion tool 115 has expanded the lower tubular 185 and the lower sealing apparatus 300 in the same manner as described in the previous paragraph regarding the upper sealing apparatus 200. Thereafter, the expansion tool 115 is moved to a predetermined point near the slots 140 as illustrated on FIG. 5.

Figure 5:
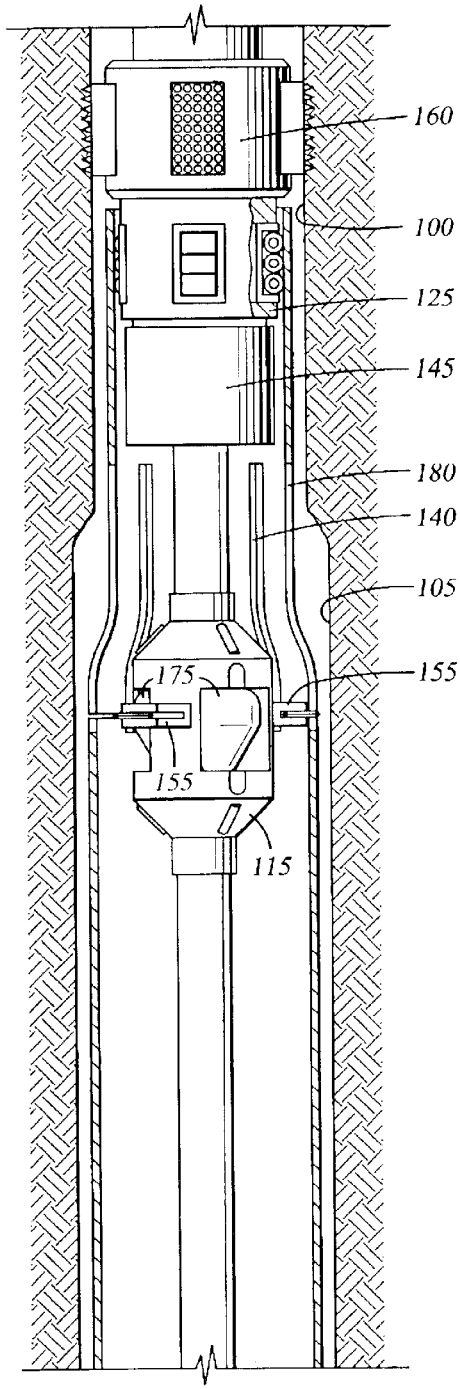
FIG. 5 is a cross-sectional view illustrating the blades on the expansion tool cutting an upper portion of the expandable liner assembly.

FIG. 5 is a cross-sectional view illustrating the blades 155 on the expansion tool 115 cutting an upper portion of the expandable liner assembly 150. As shown, the expansion tool 115 has moved laterally upward to a predetermined point below the slots 140 on the upper tubular 180. As further shown, the rollers 175 have been retracted and the blades 155 have been extended outward until they contact the inner surface of the upper tubular 180. As the motor 145 rotates the expansion tool 115 during the cutting operation, the lower ends of the slots 140 are cut to create finger-like members.

Figure 6:
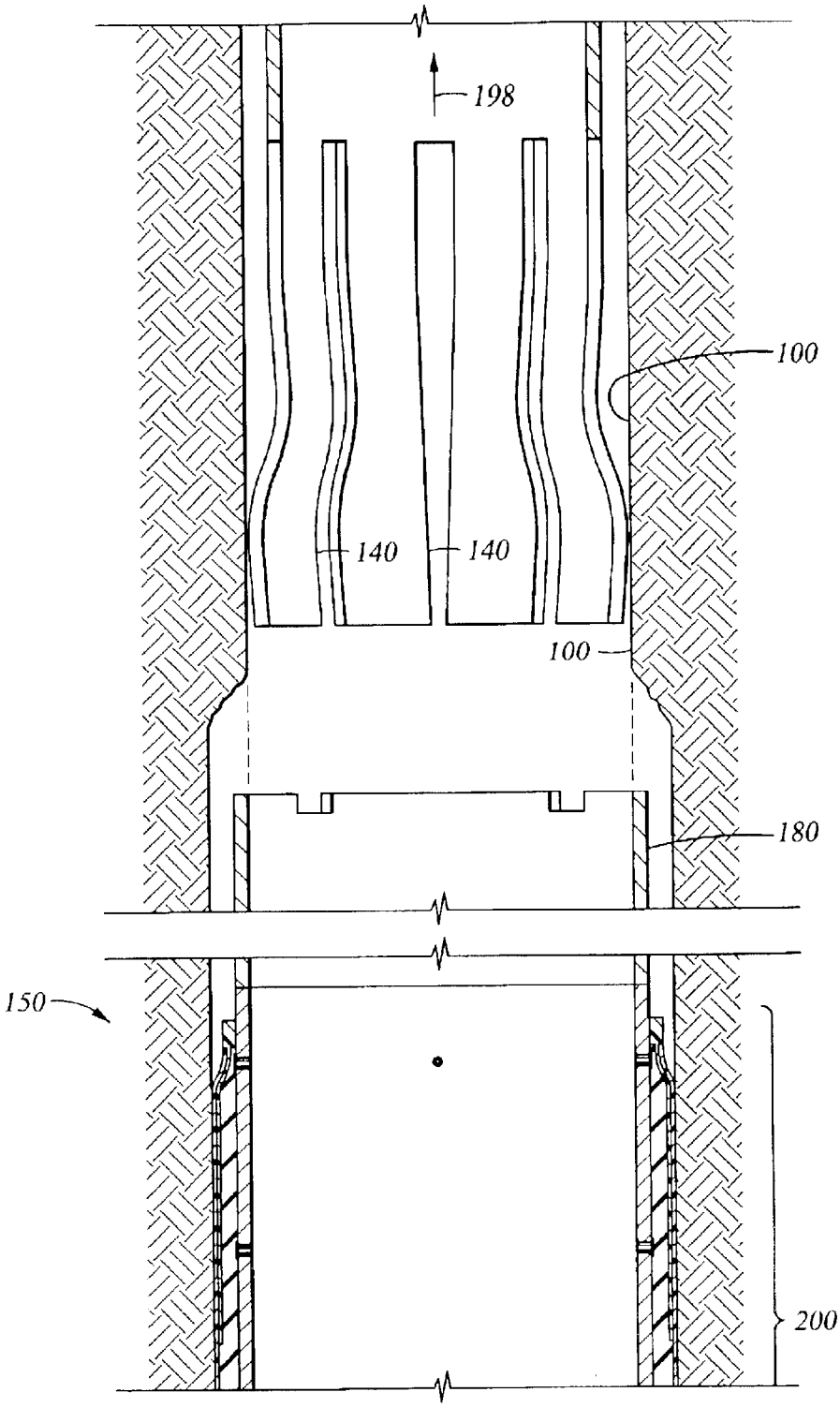
FIG. 6 is a cross-sectional view illustrating the removal of the upper tubular from the wellbore.

FIG. 6 is a cross-sectional view illustrating the removal of the upper tubular 180 from the wellbore 100. For clarity, the running assembly 170 has been removed in FIG. 6. As shown, the lower end slots 140 have been cut by the expansion tool 115. Upon upward movement, as shown by arrow 198, the finger-like members collapse radially inward to allow the upper portion of the tubular 180 to be removed from the wellbore 100.

Figure 7:
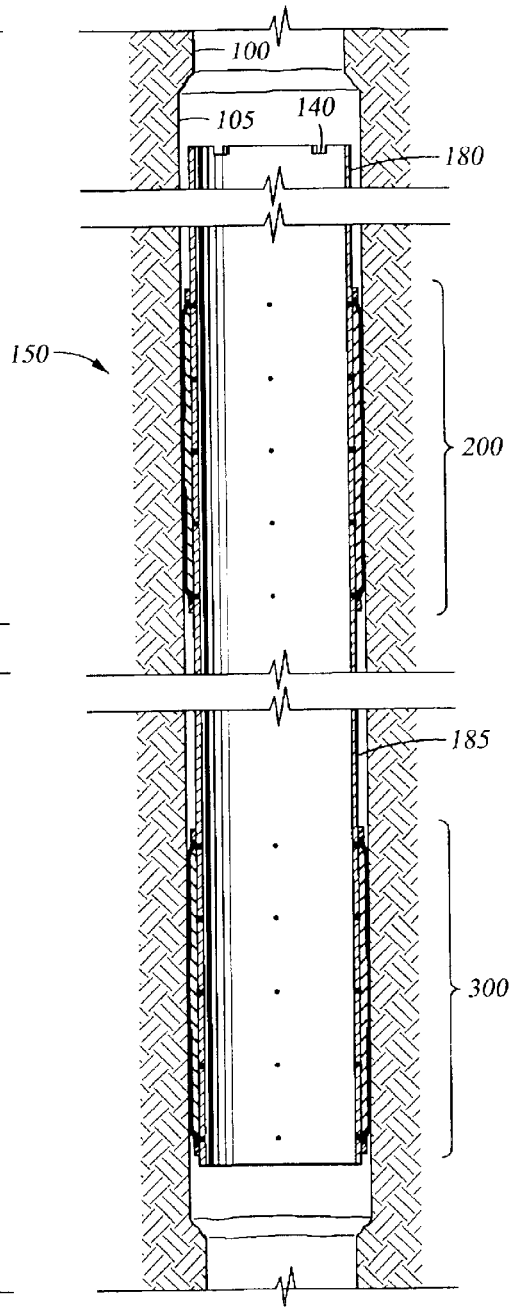
FIG. 7 is a cross-sectional view of the liner assembly fully expanded into contact with the surrounding wellbore.

FIG. 7 is a cross-sectional view of the liner assembly 150 fully expanded into contact with the surrounding wellbore 100. As depicted, a portion of the upper tubular 180, lower tubular 185 and the upper and lower sealing apparatus 200, 300 of this present invention are expanded into the prepared section 105 of the wellbore 100. As shown, the inner diameter of liner assembly 150 is comparable to the inner diameter of the wellbore 100 above and below the liner assembly 150. In this manner, the liner assembly 150 may isolate a zone within the wellbore 100 without restricting the inner diameter of the wellbore 100, thereby allowing further exploration or unrestricted drilling of the wellbore 100.

In operation, the running assembly and liner assembly are lowered by the workstring to a predetermined point in the wellbore. Thereafter, the upper torque anchor on the running assembly is energized to secure the running assembly and expandable liner assembly in the wellbore. Subsequently, at a predetermined pressure, the pistons in the expansion tool are actuated and the rollers are extended until they contact the inner surface of the liner assembly. The rollers of the expansion tool are further extended until the rollers plastically deform the liner assembly into a state of permanent expansion. The motor rotates the expansion tool during the expansion process, and the liner assembly is expanded until the outer surface of the sealing element on the sealing apparatus contacts the inner surface of the wellbore. As the expansion tool translates axially downward during the expansion operation, the rollers knock off the upper portion of the plug members, thereby removing the fluid barrier to allow fluid in the annulus to travel through the apertures into contact with the swelling elastomer. As the fluid or activating agent contacts the swelling elastomer, the polymer chains change positions, thereby expanding the swelling elastomer laterally and radially to create a pressure energized seal with one or more adjacent surfaces in the wellbore.

The expansion tool continues to move axially downward expanding the entire length of the liner assembly. Thereafter, the expansion tool moves laterally upward to a predetermined point below the slots on the upper tubular. Subsequently, the blades on the expansion tool extend radially outward until they contact the inner surface of the upper tubular. As the motor rotates the expansion tool during the cutting operation, the lower ends of the slots are cut to create finger-like members on a portion of the upper tubular. Thereafter, the running assembly and the portion of the upper tubular are removed from the wellbore.

While the foregoing is directed to embodiments of the present invention, other and further embodiments of the invention may be devised without departing from the basic scope thereof, and the scope thereof is determined by the claims that follow.

What is claimed is:

1. An apparatus for sealing a wellbore, the apparatus comprising:

a tubular body having an inner surface and an outer surface, the tubular body including one or more apertures in a wall thereof to allow selective fluid communication between the inner surface and the outer surface; and a swelling elastomer disposed around the outer surface of the tubular body, the swelling elastomer isolated from wellbore fluid in an annulus; whereby upon the application of an outwardly directed force to the inner surface of the tubular body, the tubular body expands radially outward causing the swelling elastomer to contact the wellbore while exposing the swelling elastomer to an activating agent via the one or more apertures, thereby causing the swelling elastomer to create a pressure energized seal with one or more adjacent surfaces in the wellbore.

2. The apparatus of claim 1, wherein the swelling elastomer comprises a cross-linked polymer, whereby upon exposure to the activating agent the swelling elastomer increases in volume.

3. The apparatus of claim 1, further including one or more plug members disposed in the one or more apertures to act as a fluid barrier prior to expansion of the tubular body.

4. The apparatus of claim 1, wherein upon expansion of the tubular body, a first portion of the wellbore is sealed from a second portion of the wellbore.

5. The apparatus of claim 1, wherein the swelling elastomer is substantially enclosed within a deformable portion.

6. The apparatus of claim 5, further including a plurality of deformable upper ribs and a plurality of deformable lower ribs disposed around the tubular body to support the deformable portion.

7. The apparatus of claim 6, wherein the plurality of deformable upper ribs and the plurality of deformable lower ribs are embedded within the deformable portion.

8. The apparatus of claim 6, wherein the plurality of deformable upper ribs and the plurality of deformable lower ribs are fabricated out of a metallic material.

9. The apparatus of claim 6, further including an upper and lower end member disposed around the tubular body, whereby the upper end member secures a top portion of the deformable portion and the upper deformable ribs, and the lower end member secures a lower portion of the deformable portion and the lower deformable ribs.

10. The apparatus of claim 6, whereby the upper and lower end members are machined from composite material.

11. The apparatus of claim 1, wherein the outwardly directed force supplied to the inner surface of the tubular body is applied by an expansion tool.

12. The apparatus of claim 1, wherein the activating agent is wellbore fluid.

13. A method for sealing a portion of a wellbore, comprising:

running a sealing apparatus into the wellbore, the sealing apparatus comprising:

a tubular body having an inner surface and an outer surface, the tubular body including one or more apertures therethrough to allow selective fluid communication between the inner surface and the outer surface; and a swelling elastomer disposed around the outer surface of the tubular body, the swelling elastomer substantially enclosed within a deformable portion;

applying an outwardly directed force upon the inner surface of the tubular body causing the tubular body to expand radially outward; and exposing the swelling elastomer to an activating agent, thereby causing the deformable portion to create a pressure energized seal with one or more adjacent surfaces in the wellbore.

14. The method of claim 13, further including knocking off one or more plug members disposed in the one or more apertures, thereby allowing the activating agent to flow through the one or more apertures.

15. The method of claim 13, further including disposing a second sealing apparatus in the wellbore and expanding the second sealing apparatus to seal a second portion of the wellbore.

16. The method of claim 15, wherein the second sealing apparatus is disposed below the sealing apparatus.

17. A liner assembly for isolating a zone in a wellbore, the liner assembly comprising:

a deformable tubular; and a sealing apparatus disposed at either end of the deformable tubular, the sealing apparatus comprising:

a tubular body having an inner surface and an outer surface, the tubular body including one or more apertures therethrough to allow selective fluid communication between the inner surface and the outer surface; and a swelling elastomer disposed around the outer surface of the tubular body, the swelling elastomer substantially enclosed within a deformable portion, whereby upon the application of an outwardly directed force to the inner surface of the tubular body, the tubular body expands radially outward, exposing the swelling elastomer to an activating agent, thereby causing the deformable portion to create a pressure energized seal with one or more adjacent surfaces in the wellbore.

18. The liner assembly of claim 17, further including one or more plug members disposed in the one or more apertures to act as a fluid barrier prior to expansion of the tubular body.

19. The liner assembly of claim 17, wherein the sealing apparatus includes a plurality of deformable upper ribs and a plurality of deformable lower ribs arranged around the tubular body to support the deformable portion.

20. The liner assembly of claim 17, wherein the deformable tubular is a screen.

21. The liner assembly of claim 17, wherein the swelling elastomer comprises a cross-linked polymer, whereby upon exposure to the activating agent, the swelling elastomer increases in size.

22. A method for sealing a wellbore, comprising:

running an expandable liner assembly on a drill string into the wellbore, the expandable liner assembly including:

a deformable tubular; and a sealing apparatus disposed at either end of the deformable tubular, the sealing apparatus comprising:

a tubular body having an inner surface and an outer surface, the tubular body including one or more apertures therethrough; and a swelling elastomer disposed around the outer surface of the tubular body, the swelling elastomer substantially enclosed within a deformable portion;

applying an outwardly directed force to the inner surface of the tubular body causing the tubular body to expand radially outward;

exposing the swelling elastomer to an activating agent, thereby causing the swelling elastomer to expand outward deforming the deformable portion to create a pressure energized seal with one or more adjacent surfaces in the wellbore; and expanding the deformable tubular.

23. The method of claim 22, wherein the expandable liner assembly further including one or more plug members disposed in the one or more apertures to act as a fluid barrier prior to expansion.

24. The method of claim 23, further including actuating a hydraulic expansion tool.

25. The method of claim 24, further including knocking off the one or more plug members, thereby allowing the activating agent to flow through the one or more apertures.

26. The method of claim 25, wherein the activating agent is wellbore fluid.

27. The method of claim 22, wherein the expandable liner includes a plurality of deformable upper ribs and a plurality of deformable lower ribs disposed around the tubular body to support the deformable portion.

28. An apparatus for sealing a wellbore, the apparatus comprising:

a tubular body having an inner surface and an outer surface;

a swelling elastomer disposed around the outer surface of the tubular body, whereupon activation of the swelling elastomer a pressure energized seal is formed between the apparatus and a surface in the wellbore; and a selectively activatable fluid pathway formed in the tubular body to allow selective fluid communication between the inner surface and the outer surface.

29. The apparatus of claim 28, wherein the selectively activatable fluid pathway is constructed from at least one aperture with at least one plug disposed therein.

30. A method for sealing a portion of a wellbore, comprising:

running a sealing apparatus into the wellbore, the sealing apparatus comprising a tubular body, one or more plug members disposed in one or more apertures formed in the tubular body and a swelling elastomer disposed around the tubular body;

expanding the tubular body radially outward; and removing one or more plug members from the one or more apertures to activate the swelling elastomer and create a pressure energized seal with a surface of the wellbore.

31. An apparatus for sealing a wellbore, the apparatus comprising:

a tubular body having one or more apertures formed therein to allow selective fluid communication between an inner surface and an outer surface;

a swelling elastomer disposed around the tubular body and substantially enclosed within a deformable portion; and a plurality of deformable ribs disposed around the tubular body to support the deformable portion.

* * * * *